US009469140B2

(12) United States Patent
Tanaka

(10) Patent No.: US 9,469,140 B2
(45) Date of Patent: Oct. 18, 2016

(54) TAPE CARTRIDGE

(71) Applicant: Brother Kogyo Kabushiki Kaisha, Nagoya-shi, Aichi-ken (JP)

(72) Inventor: Mitsugi Tanaka, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/058,670

(22) Filed: Mar. 2, 2016

(65) Prior Publication Data

US 2016/0176213 A1 Jun. 23, 2016

Related U.S. Application Data

(63) Continuation-in-part of application No. PCT/JP2014/075614, filed on Sep. 26, 2014.

(30) Foreign Application Priority Data

Oct. 31, 2013 (JP) ..... 2013-226612

(51) Int. Cl.

| | |
|---|---|
| ***B41J 2/15*** | (2006.01) |
| ***B41J 32/00*** | (2006.01) |
| ***B41J 15/04*** | (2006.01) |
| ***B41J 3/407*** | (2006.01) |

(52) U.S. Cl.

CPC ..... *B41J 32/00* (2013.01); *B41J 3/4075* (2013.01); *B41J 15/042* (2013.01); *B41J 15/044* (2013.01)

(58) Field of Classification Search

CPC ..... B41J 11/007; B41J 11/42; B41J 3/4075; B41J 3/4078

See application file for complete search history.

(56) References Cited

U.S. PATENT DOCUMENTS 6,520,696 B2 2/2003 Huss et al.
8,974,131 B2 * 3/2015 Kosuge ..... B41J 15/044 400/613
9,067,441 B2 * 6/2015 Tanaka ..... B41J 11/22

(Continued)

FOREIGN PATENT DOCUMENTS

JP H06-53560 U 7/1994
JP H07-069497 A 3/1995

(Continued)

OTHER PUBLICATIONS

Dec. 22, 2014—International Search Report—Intl App PCT/JP2014/075614.

(Continued)

*Primary Examiner* — Lamson Nguyen
(74) *Attorney, Agent, or Firm* — Banner & Witcoff, Ltd.

(57) ABSTRACT

The disclosure discloses a tape cartridge including a connecting arm, a guide attaching/detaching part, and a second guide member. The connecting arm rotatably supports a first winding core and a second winding core. The guide attaching/detaching part is configured to detachably attach a first guide member. The first guide member is configured to allow a tape fed out from a first tape roll to pass and to guide the tape by regulating movement in a tape width direction through contact with both end portions of the tape in the tape width direction. The second guide member is disposed on the connecting arm. The second guide member is configured to guide the tape passes while being guided by the first guide member, by regulating movement in a second direction through contact with one side part of the tape in the second direction.

14 Claims, 10 Drawing Sheets

(56) References Cited

U.S. PATENT DOCUMENTS 9,174,472 B2 * 11/2015 Kawai ..... B41J 15/00
2002/0012558 A1 1/2002 Huss et al.

FOREIGN PATENT DOCUMENTS

JP H08-26237 A 1/1996
JP 2001-171905 A 6/2001
JP 2006-159413 A 6/2006
JP 2006-264337 A 10/2006

OTHER PUBLICATIONS

May 12, 2016—(WO) IPRP—App PCT/JP2014/075614.

* cited by examiner

TAPE CARTRIDGE

CROSS-REFERENCE TO RELATED APPLICATION

This is a CIP application of PCT/JP2014/75614, filed Sep. 26, 2014, which was not published under PCT article 21(2) in English.

BACKGROUND

1. Field

The present disclosure relates to a tape cartridge including a tape roll around which a tape is wound so as to be fed out.

2. Description of the Related Art

Conventionally, a technology of performing print on a tape while transporting the tape including an adhesive layer and a separation material layer is known.

In this prior art, a tape roll (tag tape roll body) around which a tape (tag tape) including the adhesive layer and the separation material layer (separation sheet) is wound is attached to a tape holder storage part of a body housing for use. When the tape roll is attached to the tape holder storage part, the tape is fed out and transported by rotation of the tape roll. When a desired print is formed on the tape being transported, a tape with print is generated and cut off. In use, the separation material layer is peeled off by a user from the cut tape with print. Then, by using an adhesive force of the adhesive layer exposed by peeling-off of the separation material layer, the tape is affixed to an appropriate object to be affixed intended by the user.

As described above, in the case that the separation material layer is peeled off the tape and the tape is used, from a viewpoint of improvement in handling performance by the user, such a measure can be considered that a peeling-off part for peeling off the separation material layer from the tape is disposed and the separation material layer peeled off by the peeling-off part is wound so as to form also the separation material layer into a roll similarly to the tape, and these two rolls (the tape roll and the separation material roll) are integrated by a connecting arm and incorporated as one cartridge, and in order to smoothly perform tape transport, a guide member for guiding the tape in a tape width direction (a guide for regulating movement in the tape width direction) is disposed.

Here, there can be cases that various tapes with width-direction dimensions different from each other are used depending on a preference or application of the user. At this time, if separate cartridges are constructed for each width-direction dimension by preparing a tape roll, a separation material roll, a connecting arm, and a guide member separately for each width-direction dimension corresponding to each of the plurality of types of tape, the numbers of products to be manufactured and manufacturing processes become complicated, which causes steep rise of a manufacturing cost.

SUMMARY

An object of the present disclosure is to provide a tape cartridge which can reduce the manufacturing cost.

In order to achieve the above-described object, according to aspect of the present application, there is provided a tape cartridge comprising a first winding core that includes a first axis and an outer periphery around which a tape having a desired width-direction dimension is wound to form a first tape roll, a second winding core that includes a second axis and an outer periphery around which a part of layers of the tape is to be wound wherein the layers is peeled off from the tape fed out from the first tape roll and transported, a connecting arm that connects the first winding core and the second winding core and that rotatably supports the first winding core on one side in a connecting direction and rotatably supports the second winding core on the other side in the connecting direction, a guide attaching/detaching part that is disposed in the vicinity of a peeling-off part configured to peel-off the part of layers along a transport path of the tape in the connecting arm, and is configured to detachably attach a first guide member configured to allow the tape fed out from the first tape roll to pass in a tape posture so that a linear direction formed by a cross-sectional surface of the tape becomes a first direction in parallel with the first axis and the second axis and to guide the tape by regulating movement in a tape width direction through contact with both end portions of the tape in the tape width direction during the passing, and a second guide member that is disposed on the connecting arm and is configured to guide the tape passes while being guided by the first guide member, by regulating movement in a second direction through contact with one side part of the tape in the second direction orthogonal to a tape surface direction of the tape.

That is, the present disclosure has the first winding core around which the tape is wound, the second winding core around which the part of the layer peeled off the tape is wound, and the connecting arm rotatably supporting those two winding cores. The tape fed out by rotation of the first tape roll including the first winding core has the part of the layer peeled off after being transported, and the peeled-off part of the layer is wound around the second winding core so as to form the second tape roll.

At this time, as described above, the tape fed out from the first tape roll located on one side in a connecting direction is transported to the other side in the connecting direction to the peeling-off part where the peeling-off is performed, and the peeling-off is performed. In the present disclosure, in constitution in which the first winding core and the second winding core are integrated by the connecting arm as described above, in order to smoothly perform the tape transport as described above, a first guide member can be installed on a guide attaching/detaching part disposed in the vicinity of the peeling-off part of the connecting arm. The first guide member guides the tape by allowing the tape to pass so that a linear direction formed by a tape cross-sectional surface becomes a first direction (a direction in parallel with first and second axes of the first and second rolls. A horizontal direction, for example) while regulating movement in the tape width direction through contact with both end portions in the tape width direction.

Moreover, in the present disclosure, the connecting arm includes the second guide member. This second guide member guides the tape by contacting with one side (upper side, for example) portion in the second direction (=direction orthogonal to the first direction; direction orthogonal to the tape surface direction) of the tape passing while being guided by the first guide member as described above, and thereby regulating movement in the second direction.

The guide for regulating movement in the tape width direction by the first guide member and the guide for regulating movement in the direction orthogonal to the tape surface direction by the second guide member as described above allow smooth transport of the tape. Particularly, occurrence of riding over the first guide member on an end portion in the tape width direction or the like that can occur in the case of performing only the guide for regulating the movement in the tape width direction by using only the first guide member can be reliably prevented by the second guide member and thus, smooth tape transport can be reliably performed.

Moreover, in the present disclosure, the connecting arm including the guide attaching/detaching part and the second guide member is common for the plurality of types of tapes having the width-direction dimensions different from each other. Then, for the common connecting arm, the first tape roll, the second tape roll, and the first guide member are prepared separately for each width-direction dimension and assembled. At this time, in the present disclosure, for the plurality of types of tapes different from each other, the first guide members corresponding to the respective width-direction dimensions are prepared individually. Then, each of the first guide members corresponding to the respective tapes is selected as appropriate and attached to the guide attaching/detaching part disposed on the connected arm so that the guide for regulating the movement of the tape in the tape width direction is performed so as to allow smooth passing.

As a result, in the configuration to achieve smoother transport while allowing use of the plurality of types of tape in accordance with needs of the user, the connecting member (including the guide attaching/detaching part and the second guide member) can be made common for the plurality of types of tape. As a result, as compared with the case in which the first tape roll, the second tape roll, the connecting arm, the first guide member, and the second guide member are all prepared separately for each width-direction dimension, the manufacturing cost can be reduced.

DETAILED DESCRIPTION OF THE PREFERRED EMBODIMENTS

Figure 1:
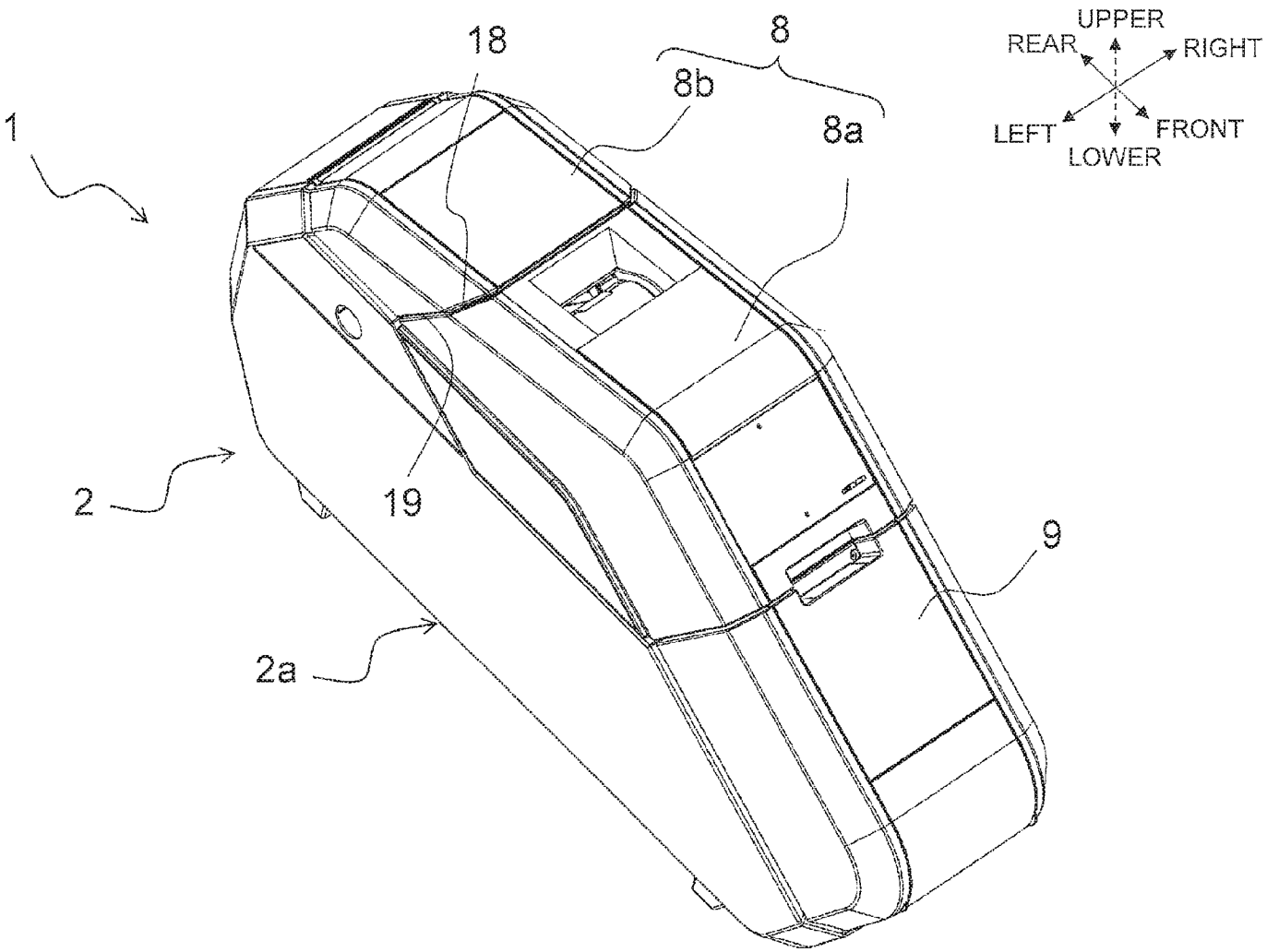
FIG. 1 is a perspective view illustrating an appearance of a tape printer according to an embodiment of the present disclosure.

An embodiment of the present disclosure will be described below by referring to the attached drawings. In the case that notes such as "front", "rear", "left", "right", "upper", and "lower" are indicated in the drawings, the "front", "rear", "left", right", "upper", and "lower" in description in the Specification refer to directions noted.

<Outline Constitution of Tape Printer>

First, outline constitution of a tape printer according to this embodiment will be described by referring to FIGS. 1 to 4.

<Housing>

In FIGS. 1 to 4, the tape printer 1 of this embodiment has a housing 2 constituting an outer shell of the apparatus. The housing 2 includes a housing body 2*a*, a rear-side opening/closing part 8, and a front-side opening/closing cover 9.

The housing body 2*a* includes a first storage part 3 disposed on the rear side and a second storage part 5 and a third storage part 4 disposed on the front side.

The rear-side opening/closing part 8 is connected capable of being opened/closed with respect to an upper part on the rear side of the housing body 2*a*. This rear-side opening/closing part 8 is capable of opening/closing an upper part of the first storage part 3 by rotating. This rear-side opening/closing part 8 includes a first opening/closing cover 8*a* and a second opening/closing cover 8*b*.

The first opening/closing cover 8*a* is capable of opening/closing the upper part of the first storage part 3 on the front side by rotating around a predetermined rotation axis K1 disposed on an upper part of the housing body 2*a* on the rear side. In detail, the first opening/closing cover 8*a* is rotatable between a closed position (states in FIGS. 1 and 2) covering the upper part of the first storage part 3 on the front side and an open position (states in FIGS. 3 and 4) where the upper part of the first storage part 3 on the front side is exposed.

Figure 2:
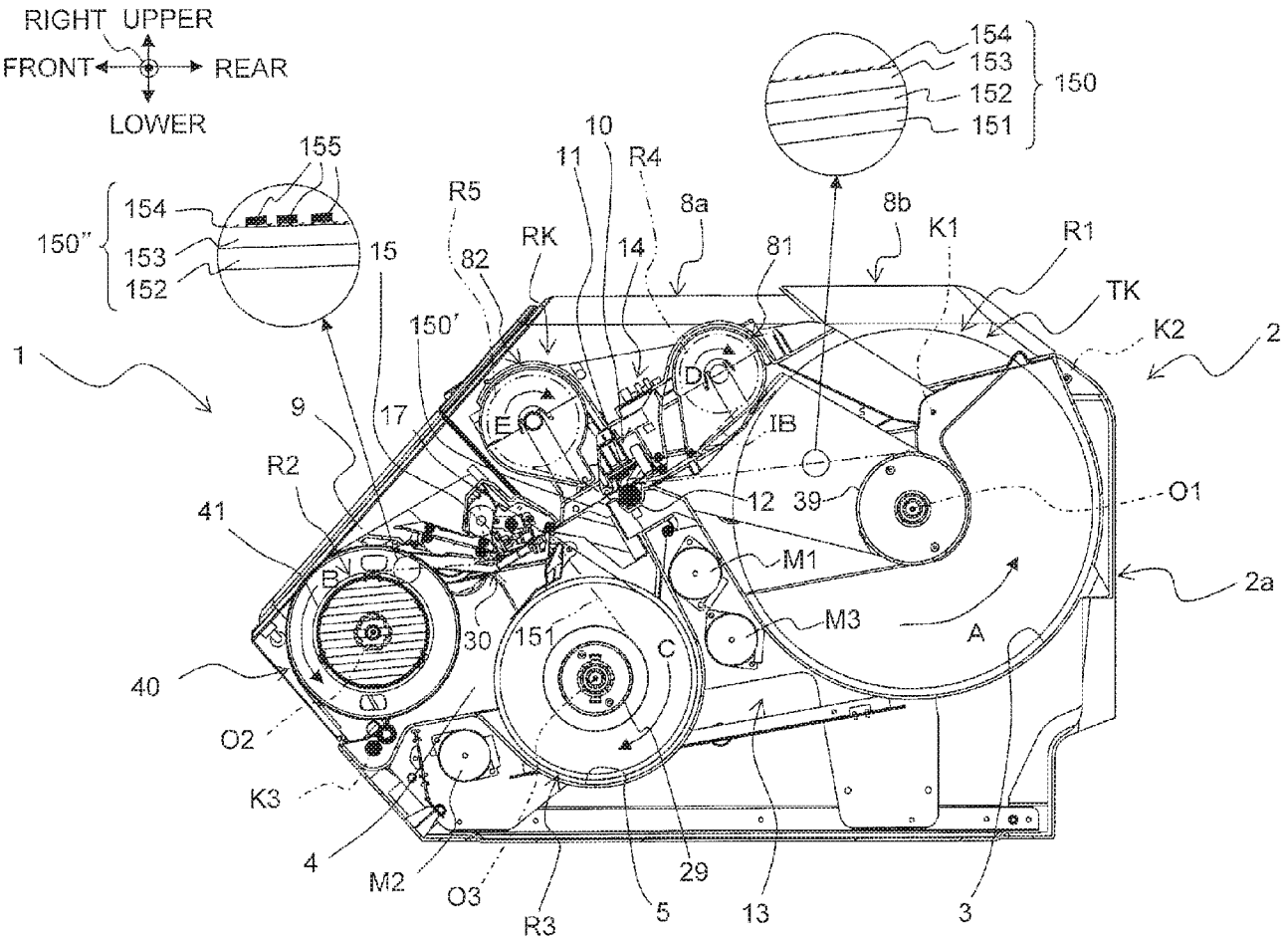
FIG. 2 is a side sectional view illustrating an internal structure of the tape printer.
Figure 3:
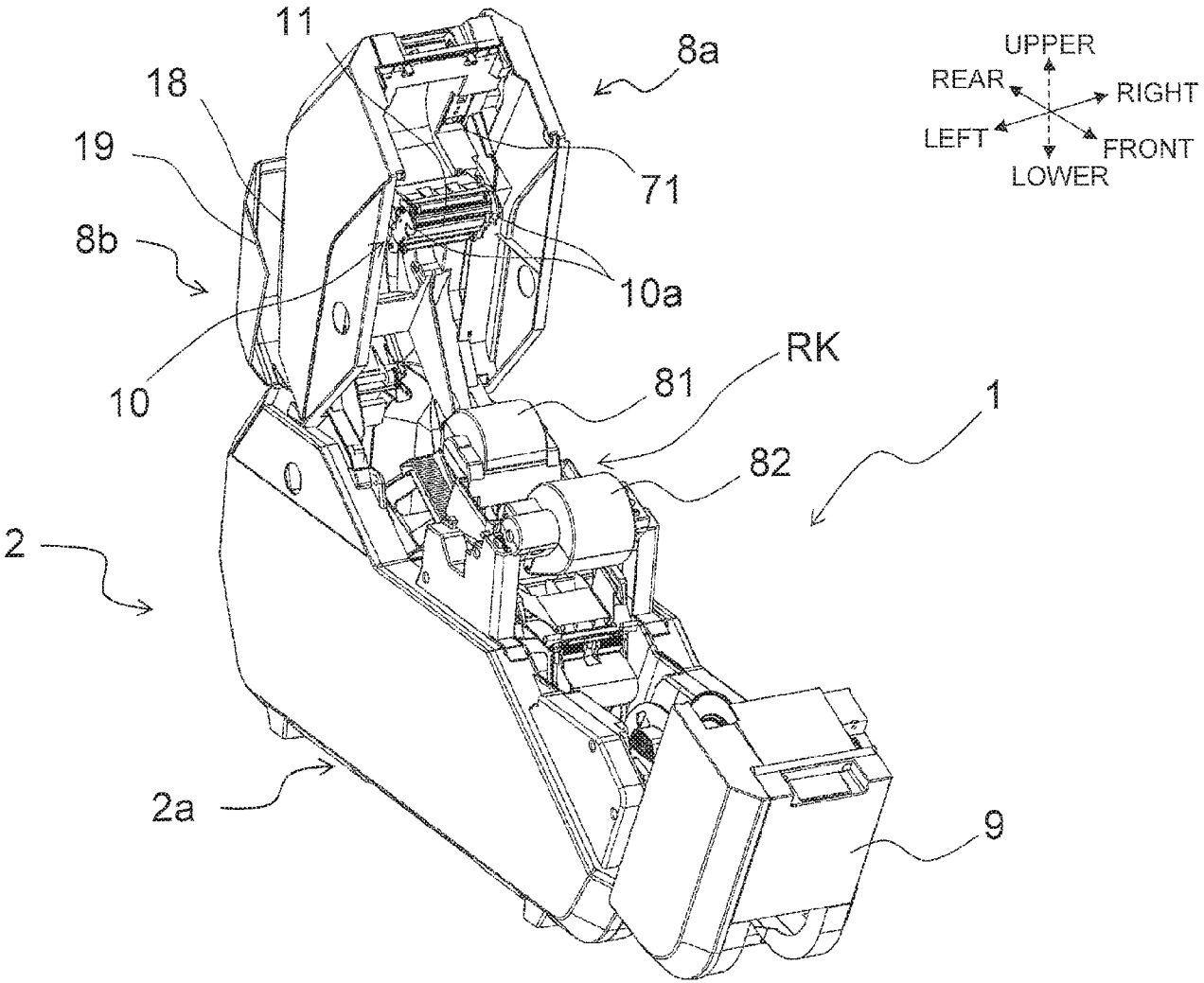
FIG. 3 is a perspective view illustrating the appearance of a state in which a first opening/closing cover, a second opening/closing cover, and a front-side opening/closing cover of the tape printer are open.

Inside the first opening/closing cover 8*a*, a head holding body 10 is disposed (see also FIG. 3). The first opening/closing cover 8*a* is capable of relatively separating/bringing a printing head 11 included in the head holding body 10 away from/closer to a transport roller 12 disposed on the housing body 2*a* by rotating around the above described rotation axis K1. In detail, the first opening/closing cover 8*a* is rotatable between the closed position (states in FIGS. 1 and 2) where the printing head 11 is close to the transport roller 12 and the open position (states in FIGS. 3 and 4) where the printing head 11 is away from the transport roller 12.

The second opening/closing cover 8*b* is disposed on the rear side from the first opening/closing cover 8*a* and is capable of opening/closing the upper part of the first storage part 3 on the rear side separately from the opening/closing of the first opening/closing cover 8*a* by rotating around a predetermined rotation axis K2 disposed on an upper end part of the housing body 2*a* on the rear side. In detail, the second opening/closing cover 8*b* is rotatable between the closed position (states in FIGS. 1 and 2) covering the upper part of the first storage part 3 on the rear side and the open position (states in FIGS. 3 and 4) where the upper part of the first storage part 3 on the rear side is exposed.

These first opening/closing cover 8*a* and the second opening/closing cover 8*b* are constituted such that an outer periphery part 18 of the first opening/closing cover 8*a* and an edge part 19 of the second opening/closing cover 8*b* are in contact with each other and cover substantially the whole of the upper part of the first storage part 3 when each of them is in the closed state.

The front-side opening/closing cover 9 is connected to the upper part of the housing body 2*a* on the front side, capable of being opened/closed. This front-side opening/closing cover 9 is capable of opening/closing the upper part of the third storage part 4 by rotating around a predetermined rotation axis K3 disposed on the upper end part of the housing body 2*a* on the front side. In detail, the front-side opening/closing cover 9 is rotatable between the closed position (states in FIGS. 1 and 2) covering the upper part of the third storage part 4 and the open position (states in FIGS. 3 and 4) exposing the upper part of the third storage part 4.

<Print-Receiving Tape Roll and its Periphery>

Figure 4:
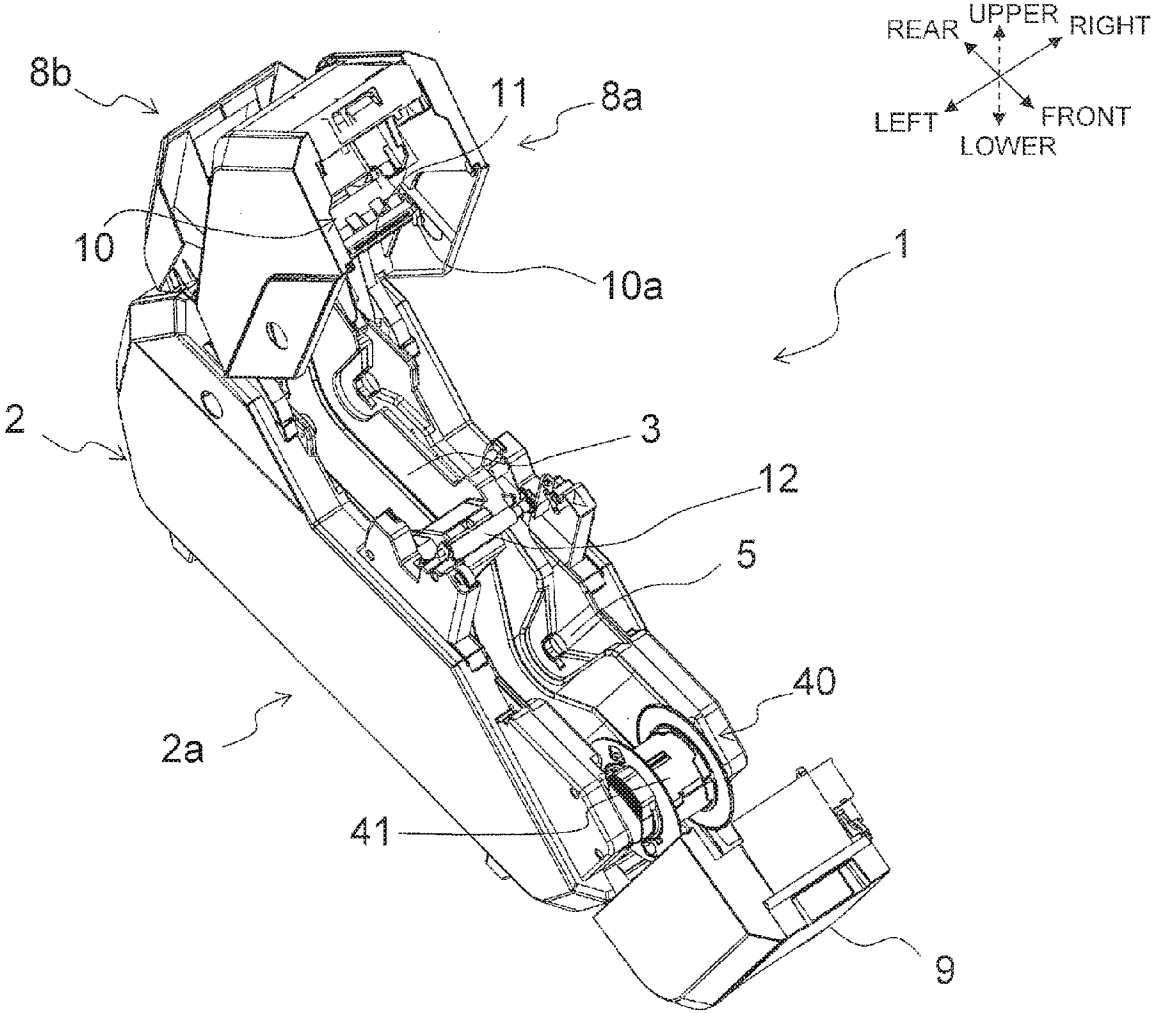
FIG. 4 is a perspective view illustrating a state in which the first opening/closing cover, the second opening/closing cover, and the front-side opening/closing cover of the tape printer are opened and a tape cartridge and an ink ribbon cartridge are removed.

At this time, as illustrated in FIGS. 2 to 4, at a first predetermined position 13 below the front-side opening/closing cover 9 in the closed state in the housing body 2*a*, a tape cartridge TK is detachably attached (see FIG. 2). This tape cartridge TK includes a print-receiving tape roll R1 wound and formed around a winding core 39 including an axis O1 in a right-and-left direction.

Figure 5:
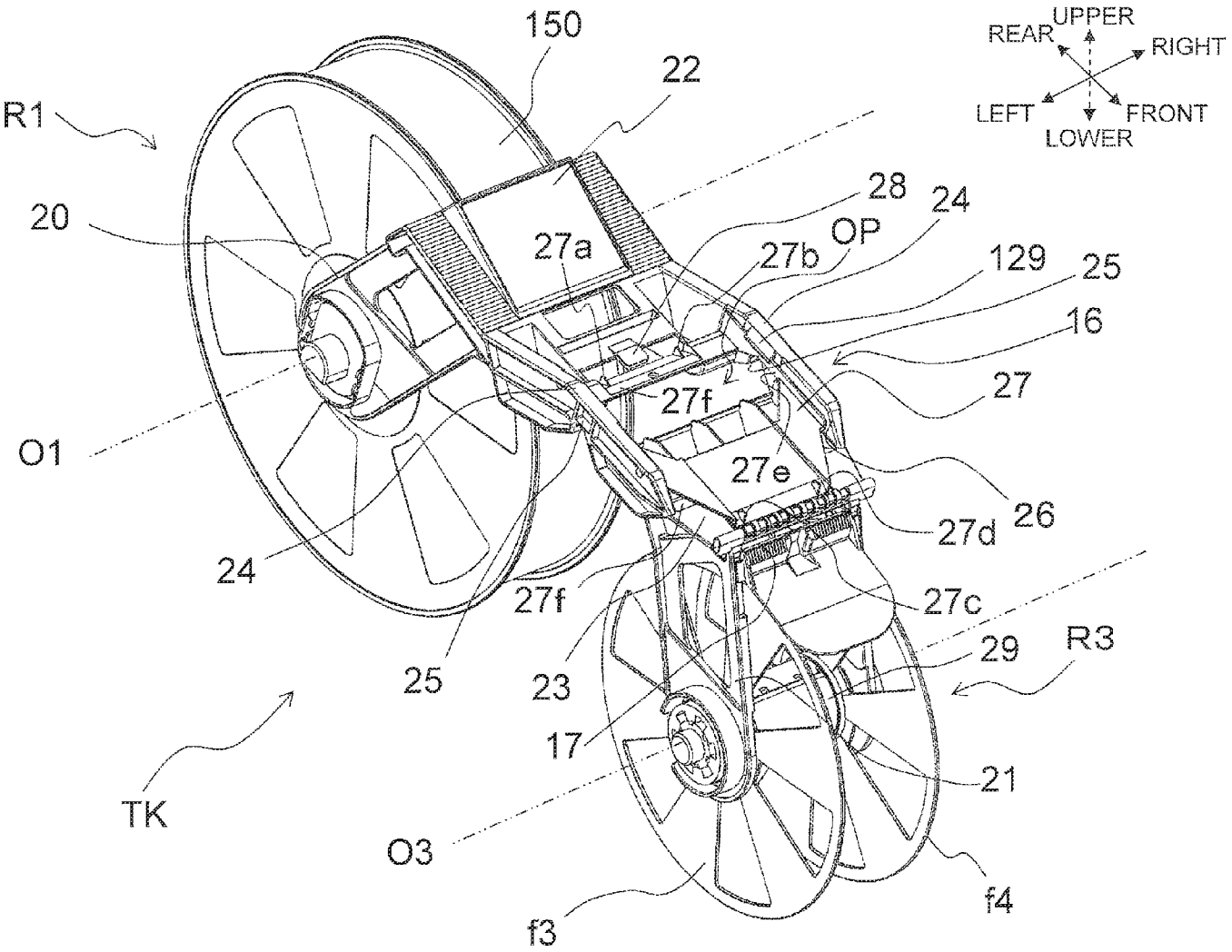
FIG. 5 is a perspective view from above illustrating entire constitution of the tape cartridge.

That is, the tape cartridge TK includes, as illustrated in FIG. 5, the print-receiving tape roll R1 and a connecting arm 16. The connecting arm 16 is disposed to connect the winding core 39 and a winding core 29 which will be described later and includes a pair of left and right first bracket parts 20, 20 disposed on the rear side and a pair of left and right second bracket parts 21, 21 disposed on the front side.

The winding core 39 is rotatably held between the left and right first bracket parts 20, 20 by being sandwiched by respective lower ends of the left and right first bracket parts 20, 20 in the right-and-left direction. In other words, the first bracket parts 20, 20 sandwich the print-receiving tape roll R1 (the winding core 39 in detail) from left and right sides along the axis O1 and hold the print-receiving tape roll R1 (the winding core 39 in detail) rotatably around the axis O1 in a state in which the tape cartridge TK is attached to the housing body 2*a* (detailed structure of holding will be described later). These first bracket parts 20, 20 face with each other in the right-and-left direction. These first bracket parts 20, 20 are connected on their respective upper end parts to a first connection part 22, and each of the first bracket parts 20 is extended downward from the first connection part 22. These first bracket parts 20, 20 are connected by the first connection part 22 extended substantially along the right-and-let direction while avoiding interference with an outer diameter of the print-receiving tape roll R1.

The print-receiving tape roll R1 is rotatable in the case that the tape cartridge TK is attached inside the housing body 2*a*. The print-receiving tape roll R1 has a print-receiving tape 150 (a print-receiving layer 154, a base layer 153, an adhesive layer 152, and a separation material layer 151 which will be described later (see an enlarged view in FIG. 2)) consumed by being fed out wound around the winding core 39 in advance.

In the first storage part 3, upon attachment of the tape cartridge TK, the print-receiving tape roll R1 is received from above and stored in a state in which the axis O1 of winding of the print-receiving tape 150 is laid in the right-and-left direction. As the print-receiving tape roll R1 feeds out the print-receiving tape 150 by rotation of the winding core 39 in a predetermined rotating direction (A direction in FIG. 2) in the first storage part 3 in a state stored in the first storage part 3 (in the state in which the tape cartridge TK is attached).

In this embodiment, the case in which the print-receiving tape 150 having adhesiveness is used is exemplified. That is, the print-receiving tape 150 has the print-receiving layer 154, the base layer 153, the adhesive layer 152, and the separation material layer 151 laminated in this order from one side (upper side in FIG. 2) in a thickness direction to the other side (lower side in FIG. 2) is formed. The print-receiving layer 154 is a layer in which a desired print part 155 (see a partially enlarged view in FIG. 2) is formed by heat transfer printing of ink by the printing head 11. The adhesive layer 152 is a layer for affixing the base layer 153 to an appropriate object to be affixed (not shown). The separation material layer 151 is a layer covering the adhesive layer 152.

<Transport Roller and Printing Head>

Returning to FIGS. 2 to 4, the transport roller 12 is disposed on an upper side in the middle of the first storage part 3 and the second storage part 5 in the housing body 2*a*. The transport roller 12 transports the print-receiving tape 150 fed out from the print-receiving tape roll R1 stored in the first storage part 3 in a tape posture with the tape width direction as the right-and-left direction by being driven by a transport motor M1 disposed inside the housing body 2*a* through a gear mechanism (not shown). At this time, as illustrated in FIG. 2, a transport path of the print-receiving tape 150 is bent at the transport roller 12. That is, the tape having been led to the front substantially along the horizontal direction (to the left in FIG. 2) has its advancing direction bent diagonally downward at the transport roller 12. In FIG. 2, the print-receiving tape 150 transported along the transport path by the transport roller 12 is indicated as appropriate by a solid line or a two-dot chain line in accordance with a tape consumption amount (or a wound amount).

Moreover, the head holding body 10 disposed on the first opening/closing cover 8*a* includes the printing head 11. The printing head 11 is, as described above, capable of separation away from/bringing closer to the transport roller 12 by rotation of the first opening/closing cover 8*a* around the rotation axis K1. That is, in the case that the first opening/closing cover 8*a* is in the closed state, the printing head 11 is brought closer to the transport roller 12, while in the case that the first opening/closing cover 8*a* is in the open state, the printing head 11 is separated away from the transport roller 12. This printing head 11 is arranged at a position facing an upper side of the transport roller 12 in the first opening/closing cover 8*a* in the closed state in the head holding body 10 so that the print-receiving tape 150 transported by the transport roller 12 is sandwiched in collaboration with the transport roller 12. Therefore, in the case that the first opening/closing cover 8*a* is in the closed state, the printing head 11 and the transport roller 12 are arranged facing each other in a vertical direction. The printing head 11 forms desired print on the print-receiving layer 154 of the print-receiving tape 150 in a state sandwiched between the printing head 11 and the transport roller 12 by using an ink ribbon IB of an ink ribbon cartridge RK which will be described later and makes it a tape with print 150'.

<Ink Ribbon Cartridge>

As illustrated in FIGS. 2 and 3, at a second predetermined position 14 below the first opening/closing cover 8*a* in the closed state and above the tape cartridge TK in the housing body 2*a*, the ink ribbon cartridge RK is detachably attached. A detailed structure of the ink ribbon cartridge RK is illustrated in FIG. 6.

Figure 6:
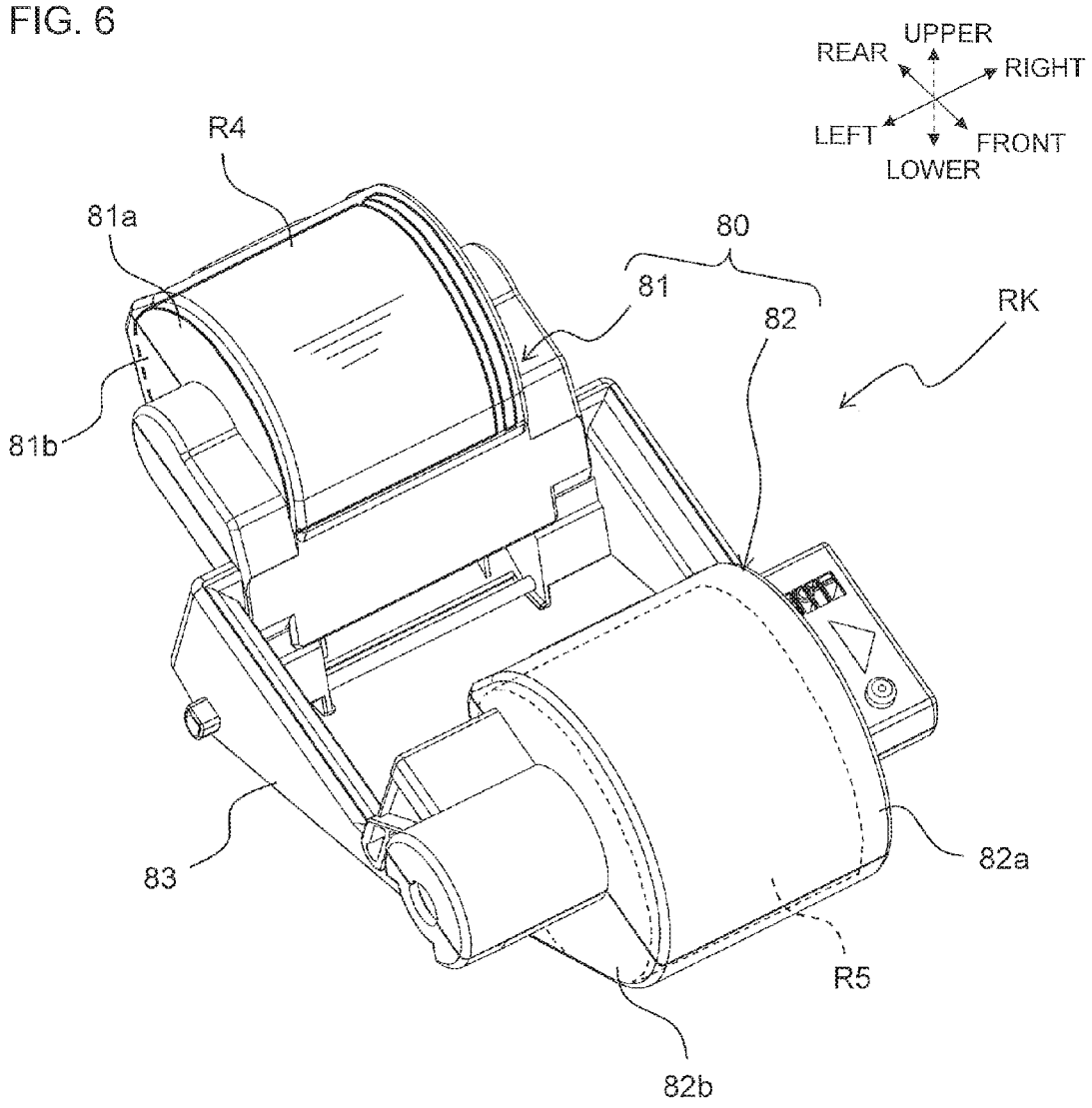
FIG. 6 is a perspective view illustrating the entire constitution of the ink ribbon cartridge.

As illustrated in FIG. 6, the ink ribbon cartridge RK includes a cartridge housing 80, a ribbon feeding-out roll R4 around which the unused ink ribbon IB is wound capable of being fed out, and a ribbon take-up roll R5. The cartridge housing 80 has a feeding-out roll storage part 81 on the rear side, a take-up roll storage part 82 on the front side, and a connection part 83 connecting those both storage parts 81, 82. The connection part 83 connects the take-up roll storage part 82 and the feeding-out roll storage part 81 while exposing the ink ribbon IB fed out from the ribbon feeding-out roll R4 outside the cartridge housing 80.

The feeding-out roll storage part 81 is formed by combining a substantially semi-cylindrical upper part 81*a* (one-side part) and a lower part 81*b*. The ribbon feeding-out roll R4 is rotatably supported in the feeding-out roll storage part 81 and feeds out the ink ribbon IB for forming print by the printing head 11 by rotating in the predetermined rotating direction (D direction in FIG. 2) in a state in which the ink ribbon cartridge RK is attached.

The take-up roll storage part 82 is formed by combining a substantially semi-cylindrical upper part 82*a* and a lower part 82*b*. The ribbon take-up roll R5 is rotatably supported in the take-up roll storage part 82 and takes up the used ink ribbon IB after print formation by rotating in the predetermined rotating direction (E direction in FIG. 2) in the state in which the ink ribbon cartridge RK is attached.

That is, in FIG. 2, the ink ribbon IB fed out from the ribbon feeding-out roll R4 is arranged on the printing head 11 side of the print-receiving tape 150 in a state sandwiched between the printing head 11 and the transport roller 12 and is brought into contact with a lower part of the printing head 11. Then, by means of heating from the printing head 11, the ink of the ink ribbon IB is transferred to the print-receiving layer 154 of the print-receiving tape 150 so as to perform print formation and then, the used ink ribbon IB is taken up by the ribbon take-up roll R5.

<Separation Material Roll and its Periphery>

As illustrated in FIG. 5, the connecting arm 16 of the tape cartridge TK includes a peeling-off part 17 having a substantially horizontal slit shape, for example. The peeling-off part 17 is disposed on a front end on an upper surface of a second connection part 23 and is extended in the right-and-left direction. This peeling-off part 17 is a part for peeling off a part of layers (in detail, the separation material layer 151) from a tape 150' with print fed out from the print-receiving tape roll R1 and transported below a second guide member 28, which will be described later, to the front side. The tape 150' with print on which the print has been formed as described above has the part of the layers (in detail, the separation material layer 151) separated by the peeling-off part 17 as illustrated in FIG. 2 so that the tape is separated into the separation material layer 151 and the tape 150" with print including the other print-receiving layer 154, the base layer 153, and the adhesive layer 152.

The tape cartridge TK has a separation material roll R3 formed by winding the peeled-off part of layers (in detail, the separation material layer 151) around the winding core 29 including an axis O3 as illustrated in FIGS. 2 and 5. That is, by attaching the above described tape cartridge TK, the separation material roll R3 is received in the second storage part 5 from above and stored in a state with the axis O3 for winding the separation material layer laid in the right-and-left direction. The separation material roll R3 has the winding core 29 driven through the gear mechanism (not shown) by a separation-sheet take-up motor M3 disposed on an interior substrate 2*b* of the housing body 2*a* in a state stored in the second storage part 5 (in the state in which the tape cartridge TK is attached), and the winding core 29 takes up the separation material layer 151 by rotating in a predetermined rotating direction (C direction in FIG. 2) in the second storage part 5.

At this time, as illustrated in FIG. 5, the second bracket parts 21, 21 of the tape cartridge TK sandwich the separation material roll R3 (in detail, the winding core 29) from the both right and left sides along the axis O3 and hold the separation material roll R3 (in detail, the winding core 29) rotatably around the axis O3 in the state in which the tape cartridge TK is attached to the housing body 2*a*. That is, the winding core 29 is sandwiched between the left and right second bracket parts 21, 21 on the respective lower ends of the left and right second bracket parts 21, 21 in the right-and-left direction and held rotatably. At this time, these second bracket parts 21, 21 face with each other in the right-and-left direction. The respective upper ends of the second bracket parts 21, 21 are connected to the second connection part 23 extended substantially along the right-and-left direction, that is, these second bracket parts 21, 21 are connected by the second connection part 23 on the upper end parts, and each of the second bracket parts 21 is extended downward from the second connection part 23. The first bracket parts 20, 20 on the rear side and the first connection part 22 as well as the second bracket parts 21, 21 on the front side and the second connection part 23 are connected by a pair of left and right roll connecting beam parts 24, 24. In other words, the right-side roll connecting beam part 24 has its rear end connected to the first bracket part 20 on the rear side and on the right side and has its front end connected to the second bracket part 21 on the front side and on the right side. Similarly, the left-side roll connecting beam part 24 has its rear end connected to the first bracket part 20 on the rear side and on the left side and has its front end connected to the second bracket part 21 on the front side and on the left side.

Figure 7:
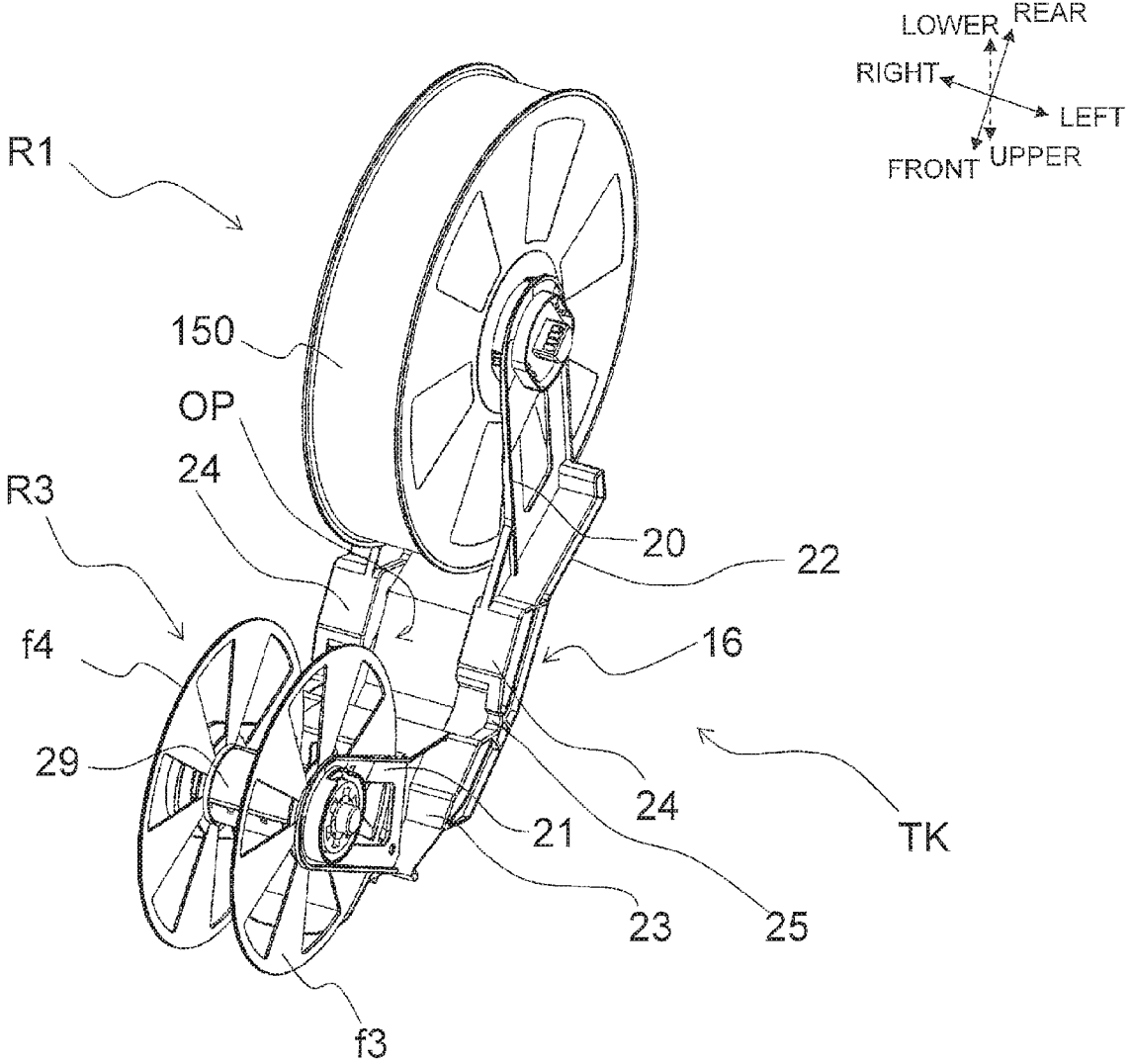
FIG. 7 is a perspective view from below illustrating the entire constitution of the tape cartridge.
Figure 8:
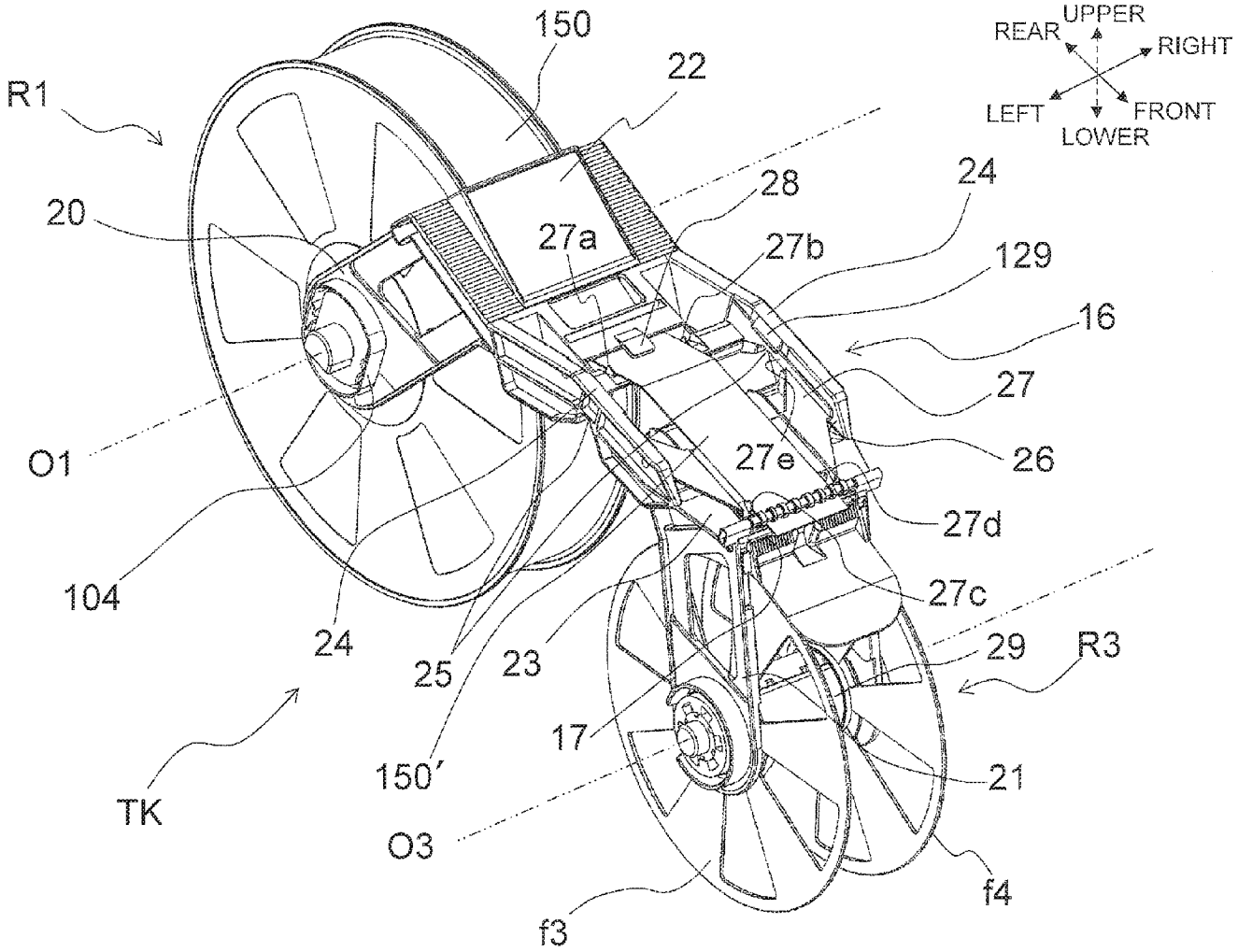
FIG. 8 is a perspective view illustrating the entire constitution of the tape cartridge at tape feeding-out.

As illustrated in FIG. 7 and above described FIGS. 5 and 8, on lower ends substantially in the middle of each of the pair of left and right roll connecting beam parts 24, 24, a pair of left and right roller storage parts 25, 25 each of which is a groove having a substantially semicircular shape are disposed. These roller storage parts 25, 25 store an upper half of the transport roller 12 in the state in which the tape cartridge TK is attached to the housing body 2*a*. At this time, by means of the second connection part 23, the first connection part 22, and the left and right roll connecting beam parts 24, 24, an opening OP is defined. The left and right roller storage parts 25, 25 are disposed on the opening OP, in which the left-side roller storage part 25 is penetrated through from an inner surface to an outer surface of the left-side roll connecting beam part 24 on the left side, while the right-side roller storage part 25 is penetrated through from an inner surface to an outer surface of the right-side roll connecting beam part 24 on the right side.

In FIG. 5, a state before the separation material layer 151 is wound around the winding core 29 including the axis O3 to form the separation material roll R3 (in the case of the unused tape cartridge TK) is illustrated. That is, the roll flange parts f3, f4 each having a substantially circular shape and disposed so as to sandwich the both sides of the separation material layer 151 in the width direction are illustrated, and reference character "R3" is given for convenience to a spot where the separation material roll R3 is formed.

<Tape Roll with Print and its Periphery>

On the other hand, as illustrated in FIGS. 2 and 4, in the third storage part 4, a take-up mechanism 40 for sequentially winding the tape 150" with print is received from above. The take-up mechanism 40 is stored so that a winding core 41 is rotatably supported around an axis O2 in a state in which the axis O2 of winding of the tape 150" with print is in the right-and-left direction. In the state stored in the third storage part 4, the take-up mechanism 40 is driven by the adhesive take-up motor M2 disposed in the housing body 2*a* through the gear mechanism, not shown, and the winding core 41 rotates in a predetermined rotating direction (B direction in FIG. 2) in the third storage part 4 so that the tape 150" with print is taken up and laminated. As a result, the tape 150" with print is sequentially wound on an outer periphery side of the winding core 41 of the take-up mechanism 40 to form a tape roll R2 with print.

<Cutter Mechanism 30>

As illustrated in FIG. 2, a cutter mechanism 30 is disposed on a downstream side of the printing head 11 along a tape transport direction and on an upstream side of the tape roll R2 with print.

The cutter mechanism 30 has a movable blade and a running body capable of running in the tape width direction (in other words, in the right-and-left direction) while supporting the movable blade, though not shown in detail. Running of the running body driven by a cutter motor (not shown) and moving of the movable blade in the tape width direction cut the tape 150" with print in the width direction. The cutter mechanism 30 is located on the downstream side from the printing head 11 along the transport path and on the upstream side from the take-up mechanism 40 including the winding core 41.

<Outline of Operation of Tape Printer>

Next, an outline of an operation of the tape printer 1 with the above described constitution will be described.

That is, in the case that the tape cartridge TK is attached at the first predetermined position 13, the print-receiving tape roll R1 is stored in the first storage part 3 located on the rear side of the housing body 2*a*, and the axis O3 side forming the separation material roll R3 is stored in the second storage part 5 located on the front side of the housing body 2*a*. In the third storage part 4 located on the front side of the housing body 2*a*, the take-up mechanism 40 for forming the tape roll R2 with print is stored.

At this time, in the case that the transport roller 12 is driven, the print-receiving tape 150 fed out by rotation of the print-receiving tape roll R1 stored in the first storage part 3 is transported to the front side. Then, the desired print is formed on the print-receiving layer 154 of the print-receiving tape 150 being transported by the printing head 11 to form the tape 150' with print. The tape 150' with print on which the print has been formed is further transported to the front side and when it is transported to the peeling-off part 17, the separation material layer 151 is peeled off in the peeling-off part 17, and the adhesive tape 150" with print is formed. The peeled-off separation material layer 151 is transported to the lower side and led into the second storage part 5 and wound in the second storage part 5 so as to form the separation material roll R3.

On the other hand, the adhesive tape 150" with print in which the separation material layer 151 has been peeled off is further transported to the front side and led into the third storage part 4 and wound on the outer periphery side of the take-up mechanism 40 in the third storage part 4 so as to form the tape roll R2 with print. At that time, the cutter mechanism 30 disposed on the downstream side (that is, the front side) in the transport direction cuts the adhesive tape 150" with print. As a result, the adhesive tape 150" with print being wound around the tape roll R2 with print can be cut at timing desired by the user, and the tape roll R2 with print can be taken out of the third storage part 4 after the cutting.

At this time, though illustrated description will be omitted, a non-adhesive tape (tape without the adhesive layer 152 and the separation material layer 151) may be wound around the print-receiving tape roll R1. In this case, too, in the first storage part 3, the print-receiving tape roll R1 around which the non-adhesive tape is wound is received from above upon attachment of the tape cartridge TK and is stored in the state with the axis O1 of winding of the non-adhesive tape laid in the right-and-left direction. Then, the print-receiving tape roll R1 feeds out the non-adhesive tape by rotating in the predetermined rotating direction (the A direction in FIG. 2) in the first storage part 3 in the state stored in the first storage part 3 (in the state in which the tape cartridge TK is attached).

Moreover, at this time, a chute 15 (see FIG. 2) for switching the transport path of the non-adhesive tape (or it may be the print-receiving tape 150) between a side toward the tape roll R2 with print and a side toward a discharging exit (not shown) may be arranged. That is, by switching the tape path through a switching operation of the chute 15 by a switching lever (not shown), the non-adhesive tape (or the tape 150" with print) after print formation may be discharged to an outside of the housing 2 as it is through the discharging exit (not shown) disposed on the second opening/closing cover 8*b* side of the housing 2, for example, without winding it in the third storage part 4 as will be described later.

<Guide Mechanism in Tape Width Direction and Tape Vertical Direction>

One of features of this embodiment is a guide member disposed for smoother transport of the print-receiving tape 150 in the tape cartridge TK. The details will be sequentially described below.

<First Guide Member>

As described above, in this embodiment, in the configuration in which the print-receiving tape roll R1 and the separation material roll R3 are integrated by the connecting arm 16 as described above, in order to perform smooth tape transport as described above, in the connecting arm 16, in the vicinity of the peeling-off part 17 along the tape transport path and also between the roll connecting beam parts 24, 24, a recess part 26 opened upward is formed as illustrated in FIGS. 5 and 8.

In the recess part 26, a first guide member 27 is detachably attached. The first guide member 27 includes guide projections 27*a*, 27*b* protruding upward on both right and left sides on the rear side and guide projections 27*c*, 27*d* protruding upward on both right and left sides on the front side. By means of these guide projections 27*a*-27*d*, in the state attached to the recess part 26, the first guide member 27 allows the print tape 150' with print (see FIG. 8) corresponding to the print-receiving tape 150 fed out from the print-receiving tape roll R1 to pass in a tape posture so that a direction of a straight line formed by the tape cross sectional surface is in the right-and-left direction (horizontal direction) and also guides it by regulating movement in the tape width direction during the passing (see FIG. 8). As a result, smooth tape transport can be reliably performed.

As illustrated in FIGS. 5 and 8, the first guide member 27 includes a pair of left and right substrate parts 27*e*, 27*e* fixed to inner sides of the roll connecting beam parts 24, 24. On a front end part and a rear end part between the substrate parts 27*e*, 27*e*, protruding parts 27*f*, 27*f* protruding downward from the substrate parts 27*e*, 27*e* and fitted with the recess part 26 are disposed. At this time, on the front end part between the substrate parts 27*e*, 27*e*, the guide projections 27*c*, 27*d* protrude upward. On the rear end part between the substrate parts 27*e*, 27*e*, the guide projections 27*a*, 27*b* protrude upward. The guide projection 27*a* and the guide projection 27*b* as well as the guide projection 27*c* and the guide projection 27*d* are arranged separately from each other by a separation distance substantially equal to the tape width-direction dimension (desired width-direction dimension) of the tape 150' with print being transported and are brought into contact with the both end parts in the tape width direction of the tape 150' with print.

That is, one first guide member 27 corresponding to the type (tape width-direction dimension) of the print-receiving tape 150 is attached so that the protruding parts 27*f*, 27*f* are fitted from above in the recess part 26 between the roll connecting beam parts 24, 24 of the connecting arm 16. As a result, the tape 150' with print being transported passes in the tape posture with the tape width direction laid in the right-and-left direction between the guide projections 27*a*, 27*b* as well as the guide projections 27*c*, 27*d* of the first guide member 27 in the state held in the recess part 26. At this time, the both end parts of the tape 150' with print in the tape width direction are brought into contact with the inner sides of the guide projections 27*a*, 27*b* as well as the inner sides of the guide projections 27*c*, 27*d*, and the guide for regulating movement in the tape width direction is performed, respectively. As a result, the tape 150' with print can be passed smoothly.

<Second Guide Member>

In this embodiment, in addition to the first guide member 27, a tongue-shaped second guide member 28 is disposed. The second guide member 28 is disposed between the left and right roll connecting beam parts 24, 24 so as to protrude from the first connection part 22 toward the second connection part 23. The second guide member 28 is brought into contact with an upper side part of the tape 150' with print passing while being guided in the tape width direction by the first guide member 27 as described above, whereby guiding is performed while regulating movement in the vertical direction (in other words, the direction orthogonal to the tape surface direction). At this time, the second guide member 28 is not in contact with the both end parts in the width direction of the tape 150' with print as illustrated in FIG. 8 but is arranged so as to be in contact with a center part of the tape 150' with print in the width direction.

The second guide member 28 is formed integrally with the first connection part 22. The second guide member 28 is disposed so as to protrude from the rear side to the front side of the pair of left and right roll connecting beams 24, 24 (in other words, from the adhesive tape roll R1 side to the separation material tape roll R3 side).

<Positioning of Head Holding Body>

Another feature of this embodiment is that the head holding body 10 is disposed movably in the right-and-left direction (in other words, in the tape width direction), and positioning of the head holding body 10 in the right-and-left direction is performed on the tape cartridge TK side. Its contents will be described in order below.

<Occurrence of Bias of Print or the Like>

In the case that the head holding body 10 is disposed on the first opening/closing cover 8*a* as in the tape printer 1 of this embodiment, relative positions of a reference position (a center in the width direction, for example) of the print-receiving tape 150 in the tape width direction fed out on the apparatus housing 2*a* side and a print formation reference position (a center position within a print formation range, for example) by the head holding body 10 are likely to be shifted in the tape width direction from an originally set position relation due to rattling or the like of each part in the apparatus caused by an opening/closing operation of the first opening/closing cover 8*a*. In such a case, there is a concern that a print quality deteriorates such that the print formed on the print-receiving tape 150 is biased to one side in the tape width direction, for example.

<Contacted Part and Positioning Contact Part>

Thus, in this embodiment, the head holding body 10 (see FIG. 3) inside the first opening/closing cover 8*a* is movably supported by an appropriate support structure, not shown, in the right-and-left direction with respect to the first opening/closing cover 8*a*. Moreover, a pair of left and right contacted parts 10*a*, 10*a* each having a downwardly projecting piece shape are disposed on the both left and right sides of the head holding body 10.

Figure 9:
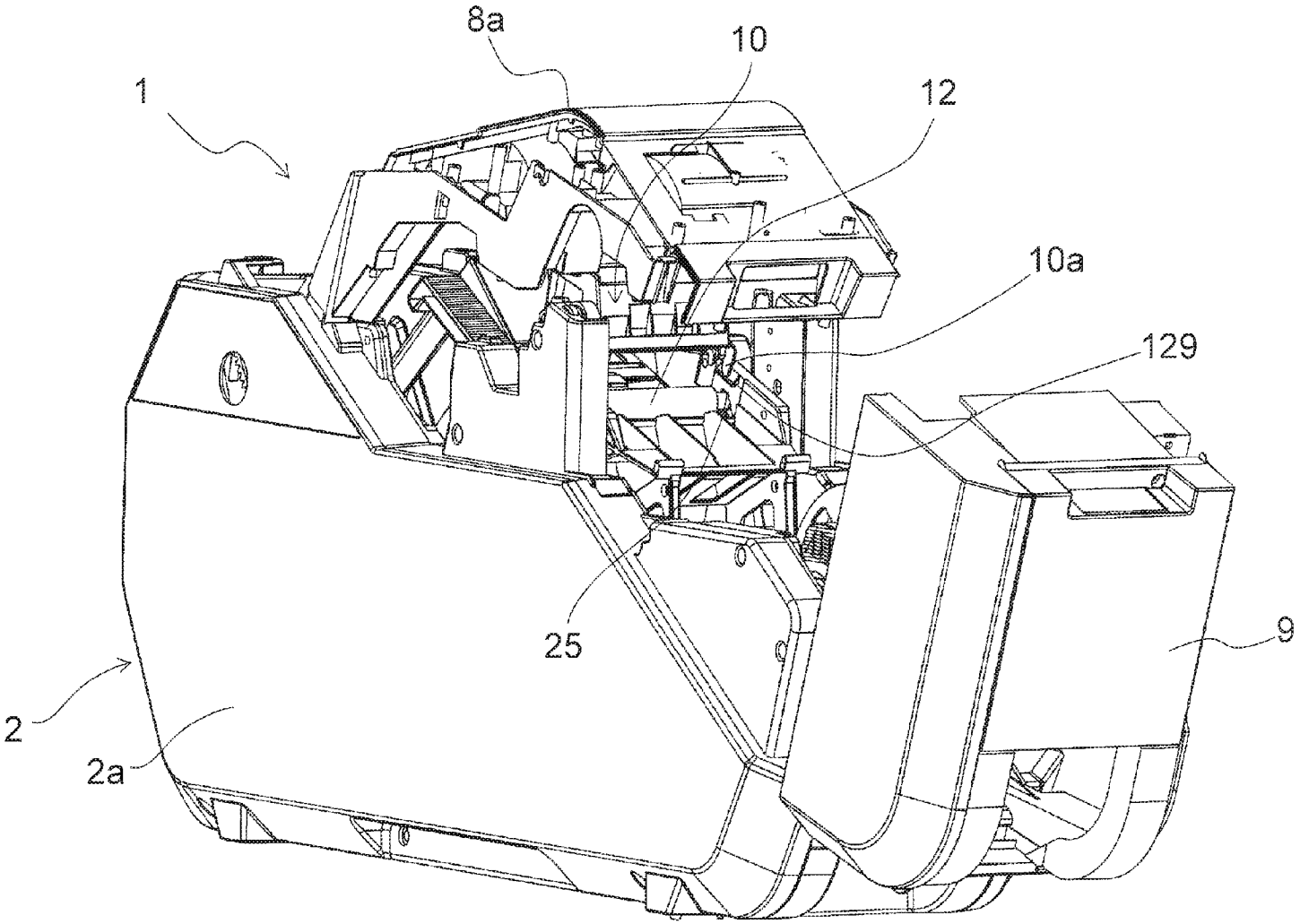
FIG. 9 is a perspective view illustrating a state immediately before the first opening/closing cover is closed.

On the other hand, in corresponding with the above, on respective upper end edges of the pair of left and right roll connecting beams 24, 24 of the connecting arm 16, left and right positioning contact parts 129, 129 are extended downward having an inverted tapered shape with respect to each other in the vicinity of each of the roller storage parts 25, 25. In detail, the right-side positioning contact part 129 is located above the right-side roller storage part 25, while the left-side positioning contact part 129 is located above the left-side roller storage part 25. At this time, the positioning contact parts 129, 129 are extended with inclination toward the downward inner side from the upper end edge of the roll connecting beam 24 and each of lower end sides of those positioning contact parts 129, 129 is a vertical surface. That is, the right-side positioning contact part 129 includes a right inclined surface extending so as to get closer to the left-side roll connecting beam 24 from the upper end edge of the right-side roll connecting beam 24 on the upper end and also includes a right-side vertical surface on a lower end. Similarly, the left-side positioning contact part 129 includes a left inclined surface extending so as to get closer to the right-side roll connecting beam 24 from the upper end edge of the left-side roll connecting beam 24 on the upper end and also includes a left-side vertical surface on the lower end. An interval between the right-side vertical surface and the left-side vertical surface is constant. In the closed state of the first opening/closing cover 8*a*, as illustrated in FIG. 9, the right-side positioning contact part 129 is brought into contact with the right-side contacted part 10*a* of the head holding body 10, while the left-side positioning contact part 129 is brought into contact with the left-side contacted part 10*a* of the head holding body 10. As a result, the positioning contact parts 129, 129 can position the head holding body 10 in the tape width direction.

<Control System>

Figure 10:
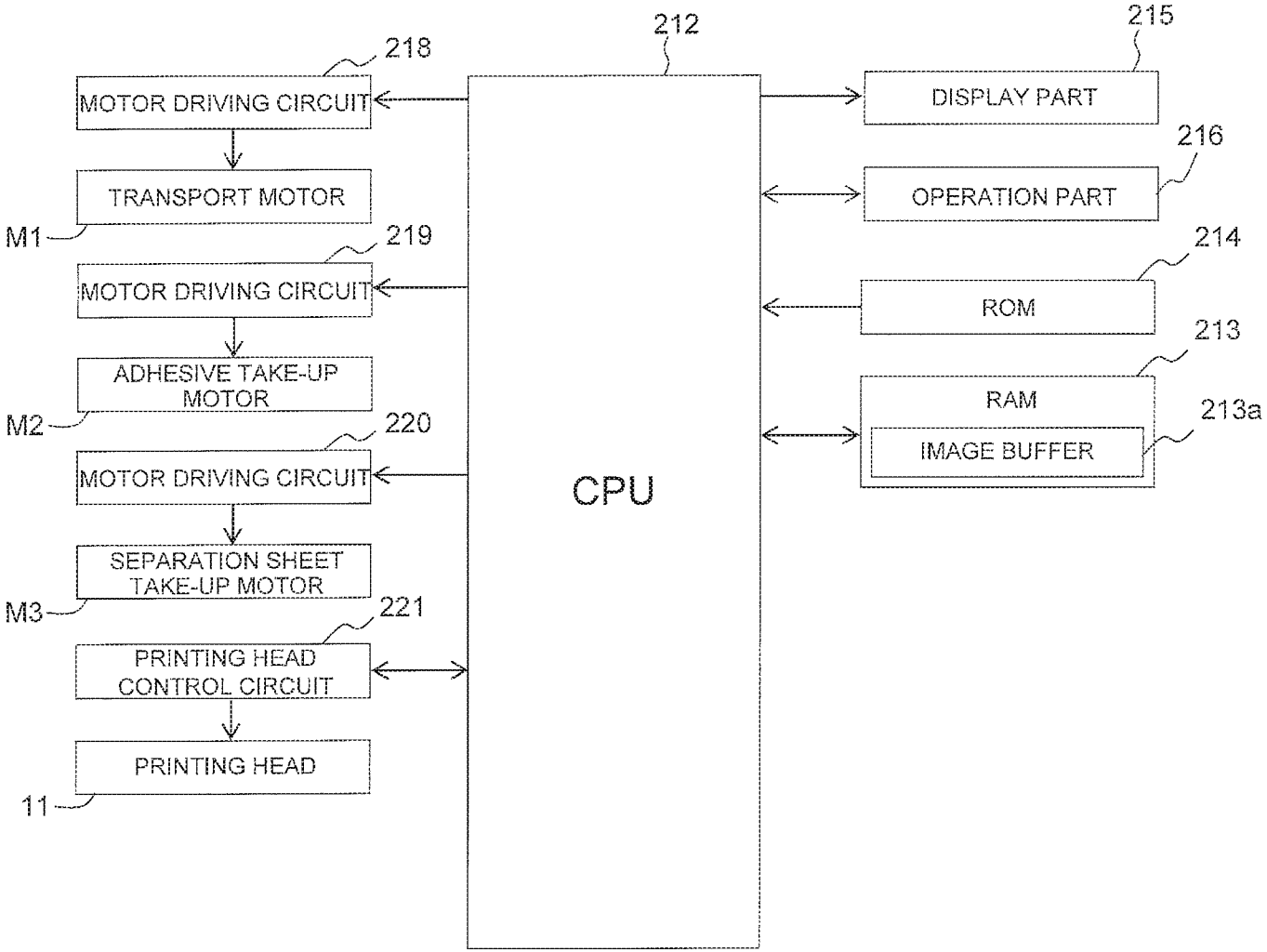
FIG. 10 is a functional block diagram illustrating configuration of a control system of the tape printer.

Next, by using FIG. 10, a control system of the tape printer 1 will be described. In FIG. 10, the tape printer 1 includes a CPU 212 constituting a calculation part performing predetermined calculation. The CPU 212 is connected to a RAM 213 and a ROM 214. The CPU 212 executes signal processing in accordance with a program stored in advance in the ROM 214 while using a temporary storage function of the RAM 213, whereby the entire tape printer 1 is controlled.

The CPU 212 is connected to a motor driving circuit 218 performing drive control of the transport motor M1 for driving the transport roller 12, a motor driving circuit 219 performing drive control of the adhesive take-up motor M2 for driving the tape roll R2 with print, a motor driving circuit 220 performing drive control of the separation sheet take-up motor M3 for driving the separation material roll R3, a printing head control circuit 221 performing conduction control of a heat generating element of the printing head 11, a display part 215 performing appropriate display, and an operation part 216 capable of input of an operation by the user as appropriate.

In the ROM 214, a control program for executing predetermined control processing is stored. In the RAM 213, an image buffer 213*a* is disposed for developing printing data in an image data format received from a PC, not shown, for example, to dot pattern data to be printed on a predetermined print area of the print-receiving layer 154 and storing it. The CPU 212 performs printing corresponding to the printing data by the printing head 11 through the printing head control circuit 221 in accordance with the printing data stored in the image buffer 213*a* while feeding out the print-receiving tape 150 by the transport roller 12 by an appropriate control program stored in the ROM 214.

<Effect by this Embodiment>

As described above, in this embodiment, in the tape cartridge TK, the first guide member 27 and the second guide member 28 are disposed. As a result, as described above, smooth transport of the tape can be realized by the guide for regulating movement in the tape width direction by the first guide member 27 and the guide for regulating movement in the direction orthogonal to the tape surface direction by the second guide member 28. Particularly, occurrence of riding over the first guide member 27 on the end part of the tape in the width direction or the like that can occur in the case that only the guide for regulating movement in the tape width direction is performed by using only the first guide member 27 can be reliably prevented by the second guide member 28, and smooth tape transport can be reliably performed.

On the other hand, there can be the case that various print-receiving tapes 150 having width-direction dimensions different from each other are used depending on a preference or application of the user. If the separate tape cartridges TK are constructed for each width-direction dimension by preparing the print-receiving tape roll R1, the separation material roll R3, the connecting arm 16, the first guide member 27, and the second guide member 28 separately for each width-direction dimension corresponding to each of the plurality of types of the print-receiving tape 150, the numbers of products to be manufactured and manufacturing processes become complicated, which causes steep rise in a manufacturing cost.

Thus, in this embodiment, the connecting arm 16 including the recess part 26 and the second guide member 28 is made common for the plurality of types of the print-receiving tape 150 with the width-direction dimensions different from each other. Then, it is so constituted that, with respect to the common connecting arm 16 and the recess part 26, the print-receiving tape roll R1, the separation material tape roll R3, and the first guide member 27 are prepared separately for each tape width-direction dimension and assembled. At this time, in this embodiment, with respect to the plurality of types of print-receiving tape 150 different from each other, the first guide member 27 corresponding to each of the tape width-direction dimensions is prepared separately and is made usable. Then, each of the first guide members 27 corresponding to the respective print-receiving tapes 150 is selected as appropriate and is attached to the recess part 26 disposed on the connecting arm 16 so that the guide for regulating movement of the tape 150' with print in the tape width direction is performed. As a result, the tape 150' with print can be passed smoothly.

As a result, in the configuration to achieve smoother transport of the tape while allowing usage of the plurality of types of the print-receiving tape 150 according to the user's needs, the connecting arm 16 (including the recess part 26 and the second guide member 28) can be made common for the plurality of types of the print-receiving tape 150. As a result, the manufacturing cost can be reduced as compared with the case that all of the print-receiving tape roll R1, the separation material tape roll R3, the connecting arm 16, the first guide member 27, and the second guide member 28 are prepared separately for each width-direction dimension.

Moreover, in this embodiment, particularly the second guide member 28 is disposed so as to protrude from the rear side to the front side in the recess part 26. As a result, by attaching the first guide member 27 corresponding to each type of the print-receiving tape 150 to the recess part 26 between the left and right roll connecting beams 24, 24 from above, the both end parts of the print-receiving tape 150 in the tape width direction can be reliably guided and the surface on the upper side of the print-receiving tape 150 can be reliably guided by the second guide member 28 (see FIG. 8).

Moreover, in this embodiment, particularly the second guide member 28 is integrally formed with the first connection part 22 of the connecting arm 16. As a result, to the plurality of types of the print-receiving tape 150 with width-direction dimensions different from each other, one second guide member 28 can be reliably disposed in common.

Moreover, in this embodiment, the head holding body 10 is disposed movably in the tape width direction with respect to the first opening/closing cover 8*a*, and the positioning contact part 129 for positioning the movable head holding body 10 is disposed on the tape cartridge TK side. On the head holding body 10, the contacted part 10*a* corresponding to that is disposed. In the case that the first opening/closing cover 8*a* is in the open state, the positioning contact part 129 is separated away from the contacted part 20*b* of the head holding body 10, while in the case that the first opening/closing cover 8*a* is in the closed state, it is brought into contact with the contacted part 10*a*. As a result, the head holding body 10 movable in the tape width direction is positioned in the tape width direction. As a result, occurrence of the above described bias in the print formed on the tapes 150', 150" with print or the like can be prevented, and a print quality can be improved without complicated print control or the like.

Moreover in this embodiment, particularly by the two positioning contact parts 129, 129 disposed on the respective both sides in the tape width direction, positioning of the head holding body 10 from the left side and positioning of the head holding body 10 from the right side can be both performed. As a result, occurrence of bias of the print can be reliably prevented, and the print quality can be reliably improved.

Moreover in this embodiment, particularly the two positioning contact parts 129, 129 are disposed in the vicinity of the roller storage part 25 storing the transport roller 12. The printing head 11 performs print formation in the state sandwiching the print-receiving tape 150 with the printing head 11 and the transport roller 12 and thus, the two positioning contact parts 129, 129 perform the above described positioning in the vicinity of positions where the print is formed. As a result, the print quality can be improved further reliably.

In the above, the case that the present disclosure is applied to the tape printer 1 performing print on the print-receiving tape 150 is described as an example, but that is not limiting, it can be also applied to a tape printer performing processing other than print on the tape.

In the above, arrows illustrated in FIG. 10 indicate an example of flows of signals and are not intended to limit the flow direction of the signals.

Moreover, other than the above, methods by the embodiment or each variation may be combined as appropriate in use.

What is claimed is:

1. A tape cartridge comprising:

a first winding core that includes a first axis and an outer periphery around which a tape having a desired width-direction dimension is wound to form a first tape roll;

a second winding core that includes a second axis and an outer periphery around which a part of layers of said tape is to be wound, wherein the layers are peeled off from said tape fed out from said first tape roll and transported;

a connecting arm that connects said first winding core and said second winding core and that rotatably supports said first winding core on one side in a connecting direction and rotatably supports said second winding core on the other side in the connecting direction;

a guide attaching/detaching part that is disposed in the vicinity of a peeling-off part configured to peel-off said part of layers along a transport path of said tape in said connecting arm, and is configured to detachably attach a first guide member configured to allow said tape fed out from said first tape roll to pass in a tape posture so that a linear direction formed by a cross-sectional surface of the tape becomes a first direction in parallel with said first axis and said second axis and to guide said tape by regulating movement in a tape width direction through contact with both end portions of said tape in the tape width direction during the passing; and a second guide member that is disposed on said connecting arm and is configured to guide said passing of the tape while being guided by said first guide member, by regulating movement in a second direction through contact with one side part of said tape in the second direction orthogonal to a tape surface direction of said tape.

2. The tape cartridge according to claim 1, wherein said connecting arm includes:

a pair of first bracket parts that is disposed on one side in said connecting direction and rotatably holds said first winding core by the first winding core being sandwiched by said first bracket parts from one side and an other side along said first axis;

a first connection part that extends and connects upper end parts of said pair of first bracket parts;

a pair of second bracket parts that is disposed on the other side in said connecting direction and that rotatably holds said second winding core by the second winding core being sandwiched by said second bracket parts from one side and the other side along said second axis;

a second connection part that extends and connects upper end parts of said pair of second bracket parts; and a pair of left and right roll connecting beam parts that is arranged by connecting said first bracket part and said first connection part as well as said second bracket part and said second connection part.

3. The tape cartridge according to claim 2, wherein said guide attaching/detaching part is a recess part formed between said pair of left and right roll connecting beams and is opened on said one side in said second direction; and said second guide member protrudes from one side to the other side in said connecting direction in said recess part.

4. The tape cartridge according to claim 2, wherein said second guide member is configured integrally with said first connection part of said connecting arm.

5. The tape cartridge according to claim 1, wherein said second guide member is configured to guide said tape in contact with a center part of the tape in a width direction.

6. The tape cartridge according to claim 5, wherein said second guide member is arranged by not being in contact with both end parts of said tape in the width direction.

7. The tape cartridge according to claim 1, further comprising said first guide member attached to said guide attaching/detaching part.

8. The tape cartridge according to claim 7, wherein said first guide member includes:

first guide projections that protrude to one side respectively in said second direction on both sides in said first direction on one side in said connecting direction; and second guide projections that protrude to one side respectively in said second direction on both sides in said first direction on an other side in said connecting direction.

9. The tape cartridge according to claim 8, wherein each of said first guide projections and said second guide projections are configured to be in contact with both end parts of said tape in the width direction.

10. A tape cartridge comprising:

a first winding core that includes an outer periphery around which a tape is wound to form a first tape roll;

a second winding core; and a connecting arm, said connecting arm comprising:

a rear-right bracket;

a rear-left bracket;

a rear bracket connection part;

a front-right bracket;

a front-left bracket;

a front bracket connection part;

a slit;

a right beam; and a left beam, an upper end of said rear-right bracket and an upper end of said rear-left bracket being connected to said rear bracket connection part;

said rear-right bracket extending towards a downward direction from said rear bracket connection part;

said rear-left bracket extending towards said downward direction from said rear bracket connection part;

said rear-right bracket and said rear-left bracket facing each other in a right-left direction;

an upper end of said front-right bracket and an upper end of said front-left bracket being connected to said front bracket connection part;

said front-right bracket extending towards said downward direction from said front bracket connection part;

said front-left bracket extending towards said downward direction from said front bracket connection part;

said front-right bracket and said front-left bracket facing each other in said right-left direction;

said slit being disposed on a front end on an upper surface of said front bracket connection part and extending in said right-left direction;

a rear end of said right beam being connected to said rear-right bracket;

a front end of said right beam being connected to said front-right bracket;

a rear end of said left beam being connected to said rear-left bracket;

a front end of said left beam being connected to said front-left bracket;

said first winding core being rotatably held by being sandwiched in said right-left direction by a lower end of said rear-right bracket and a lower end of said rear-left bracket between said rear-right bracket and said rear-left bracket;

said second winding core being rotatably held by being sandwiched in said right-left direction by a lower end of said front-right bracket and a lower end of said front-left bracket between said front-right bracket and said front-left bracket;

said slit being configured to peel off a part of layers from said tape fed out from said tape roll and transported;

said second winding core being configured to wind the part of layers;

said right beam comprising a right semicircular groove disposed on a lower end of the right beam;

said left beam comprising a left semicircular groove disposed on a lower end of the left beam;

said right semicircular groove and said left semicircular groove being disposed in an opening;

said opening being defined by said front bracket connection part, said rear bracket connection part, said right beam, and said left beam; and said right semicircular groove being penetrated through said right beam in said right-left direction, and said left semicircular groove being penetrated through said left beam in said right-left direction.

11. The tape cartridge according to claim 10, wherein said right beam includes a right positioning part disposed on an upper end edge of the right beam; and said left beam includes a left positioning part disposed on an upper end edge of the left beam.

12. The tape cartridge according to claim 11, wherein said right positioning part is located above said right semicircular groove; and said left positioning part is located above said left semicircular groove.

13. The tape cartridge according to claim 11, wherein said right positioning part includes an upper end with a right inclined surface extending from said upper end edge of said right beam and getting closer to said left beam and includes a lower end with a right vertical surface;

said left positioning part includes an upper end with a left inclined surface extending from said upper end edge of said left beam and getting closer to said right beam and includes a lower end with a left vertical surface; and an interval between said right vertical surface and said left vertical surface is constant.

14. A tape cartridge comprising:

a first winding core that includes an outer periphery around which a tape is wound to form a tape roll;

a second winding core; and a connecting arm, said connecting arm comprising:

a rear-right bracket;

a rear-left bracket;

a rear bracket connection part;

a front-right bracket;

a front-left bracket;

a front bracket connection part;

a slit;

a right beam; and a left beam, an upper end of said rear-right bracket and an upper end of said rear-left bracket being connected to said rear bracket connection part;

said rear-right bracket extending towards a downward direction from said rear bracket connection part;

said rear-left bracket extending towards said downward direction from said rear bracket connection part;

said rear-right bracket and said rear-left bracket facing each other in a right-left direction;

an upper end of said front-right bracket and an upper end of said front-left bracket being connected to said front bracket connection part;

said front-right bracket extending towards said downward direction from said front bracket connection part;

said front-left bracket extending towards said downward direction from said front bracket connection part;

said front-right bracket and said front-left bracket facing each other in said right-left direction;

said slit being disposed on a front end on an upper surface of said front bracket connection part and extending in said right-left direction;

a rear end of said right beam being connected to said rear-right bracket;

a front end of said right beam being connected to said front-right bracket;

a rear end of said left beam being connected to said rear-left bracket;

a front end of said left beam being connected to said front-left bracket;

said first winding core being rotatably held by being sandwiched in said right-left direction by a lower end of said rear-right bracket and a lower end of said rear-left bracket between said rear-right bracket and said rear-left bracket;

said second winding core being rotatably held by being sandwiched in said right-left direction by a lower end of said front-right bracket and a lower end of said front-left bracket between said front-right bracket and said front-left bracket;

said rear bracket connection part comprising a tongue located between said right beam and said left beam;

said tongue protruding from said rear bracket connection part towards said front bracket connection part;

said slit being configured to peel off a part of layers from said tape fed out from said tape roll and transported under said tongue; and said second winding core being configured to wind the part of layers.

* * * * *